US008050413B2

(12) United States Patent
Stephanson

(10) Patent No.: US 8,050,413 B2
(45) Date of Patent: Nov. 1, 2011

(54) SYSTEM AND METHOD FOR CONDITIONING A SIGNAL RECEIVED AT A MEMS BASED ACQUISITION DEVICE

(75) Inventor: Cory James Stephanson, Aptos, CA (US)

(73) Assignee: GraffitiTech, Inc., Santa Cruz, CA (US)

( * ) Notice: Subject to any disclaimer, the term of this patent is extended or adjusted under 35 U.S.C. 154(b) by 965 days.

(21) Appl. No.: 12/008,551

(22) Filed: Jan. 11, 2008

(65) Prior Publication Data

US 2009/0180628 A1 Jul. 16, 2009

(51) Int. Cl.
*H04R 29/00* (2006.01)

(52) U.S. Cl. ..... 381/56; 381/57; 381/58; 381/77; 381/79; 381/95; 381/98; 381/122

(58) Field of Classification Search ..... 381/56, 381/57, 58, 77, 78, 95, 98, 122
See application file for complete search history.

(56) References Cited

U.S. PATENT DOCUMENTS 4,538,295 A 8/1985 Noso et al.
4,881,266 A 11/1989 Nitta et al.
5,267,310 A 11/1993 Yoshiba
5,372,221 A 12/1994 Jalbert
5,438,317 A 8/1995 McMaster
5,661,470 A 8/1997 Karr
6,107,918 A 8/2000 Klein et al.
6,570,500 B1 5/2003 Pieper
6,688,169 B2 2/2004 Choe et al.
6,847,587 B2 1/2005 Patterson et al.
6,915,025 B2 7/2005 Wang et al.
7,565,286 B2 7/2009 Gracie et al.
2001/0033227 A1 10/2001 Eskildsen
2004/0202344 A1 10/2004 Anjanappa et al.
2005/0004797 A1 1/2005 Azencott
2005/0052285 A1 3/2005 Iriyama
2006/0002566 A1 1/2006 Choi et al.
2006/0139121 A1 6/2006 Jhung
2007/0268209 A1 11/2007 Wargon

*Primary Examiner* — Tan N Tran
(74) *Attorney, Agent, or Firm* — John S. Economou

(57) ABSTRACT

A system and method for monitoring for a specified frequency band is disclosed. The technology initially utilizes a micro-electromechanical system ("MEMS") based acquisition device to monitor an environment. The MEMS device receives a signal from the environment, and generates an input signal comprising an electronic representation of the received environmental signal. This input signal is then conditioned for at least one frequency band. Embodiments of the invention next allow the conditioned signal to be compared to various pre-defined events in order to determine the signal's origin.

7 Claims, 9 Drawing Sheets

SYSTEM AND METHOD FOR CONDITIONING A SIGNAL RECEIVED AT A MEMS BASED ACQUISITION DEVICE

TECHNICAL FIELD

The invention relates to the field of signal acquisition and processing.

BACKGROUND

Presently, computing systems are used throughout daily life including both work and entertainment. Examples of well known computing systems include personal computers, server computers and network computers. Many home computers are used for various forms of entertainment, such as listening to music and surfing the Internet. Many businesses provide their employees with computing systems in order to perform various office tasks, such as database entry and word processing.

Many modern computing systems are configured to input a signal through a user interface, such as a mouse or keyboard. However, these forms of data entry require affirmative steps on behalf of a person operating the mouse or keyboard. Presently, there exists a need for alternative methods of inputting data to a computing system such that the data may be adequately processed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A system and method for monitoring for a specified frequency band is disclosed. The technology initially utilizes a micro-electromechanical system ("MEMS") based acquisition device to monitor an environment. The MEMS device receives a signal from the environment, and generates an input signal comprising an electronic representation of the received environmental signal. This input signal is then conditioned for at least one frequency band. Embodiments of the invention next allow the conditioned signal to be compared to various pre-defined events in order to determine the signal's origin.

DESCRIPTION OF THE DRAWINGS

The accompanying drawings, which are incorporated in and form a part of this specification, illustrate embodiments of the technology for conditioning a signal received at a MEMS based acquisition device and, together with the description, serve to explain the principles discussed below.

Figure 1:
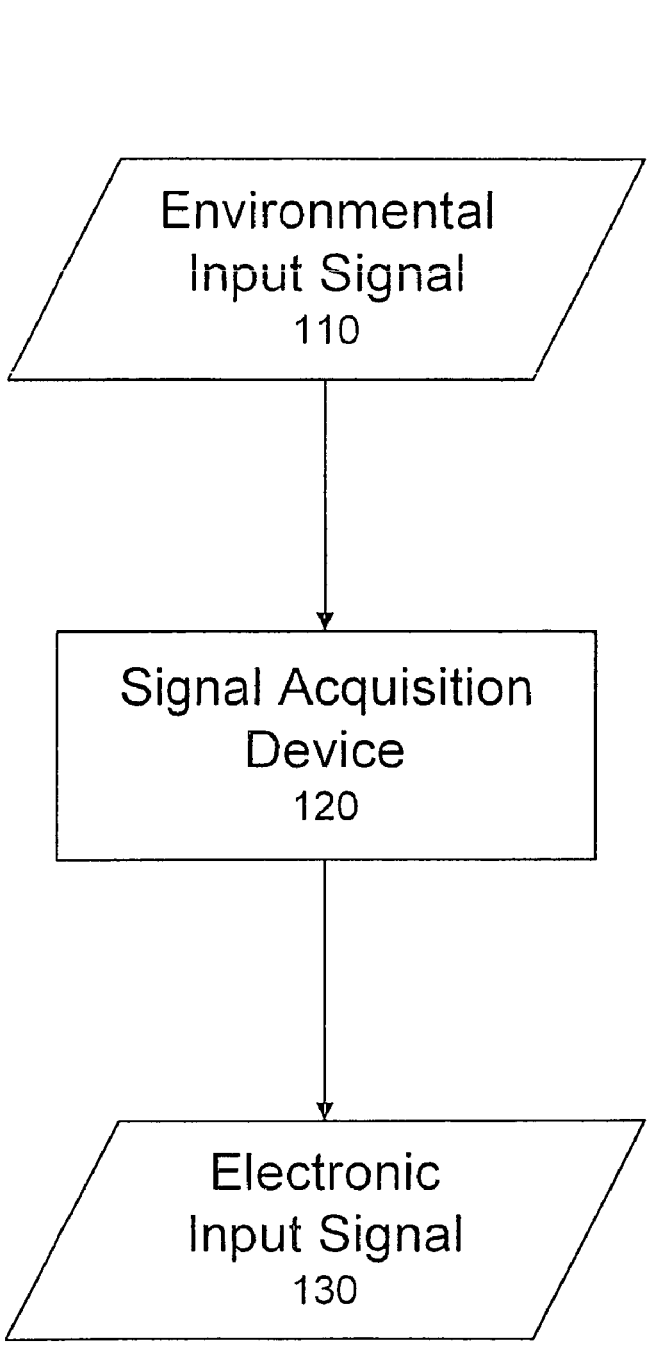
FIG. 1 is a block diagram of an exemplary system according to an embodiment of the present technology wherein an environment is monitored for an event.

The drawings referred to in this description should be understood as not being drawn to scale except if specifically noted.

DETAILED DESCRIPTION

Reference will now be made in detail to embodiments of the present technology, examples of which are illustrated in the accompanying drawings. While the technology will be described in conjunction with various embodiments, it will be understood that they are not intended to limit the present technology to these embodiments. On the contrary, the presented technology is intended to cover alternatives, modifications and equivalents, which may be included within the spirit and scope the various embodiments as defined by the appended claims.

Furthermore, in the following detailed description, numerous specific details are set forth in order to provide a thorough understanding of the present technology. However, the present technology may be practiced without these specific details. In other instances, well known methods, procedures, components, and circuits have not been described in detail as not to unnecessarily obscure aspects of the present embodiments. Additionally, it should be understood that although the event detection systems mentioned throughout this detailed description are often described as electronic detection systems, such event detection systems may be implemented utilizing hardware alone, or hardware in combination with one or more software modules that have been developed for the purpose of carrying out a task described herein. The foregoing notwithstanding, the present technology is also well suited to the use of other computer systems, such as, for example, optical and mechanical computers. Finally, it should be understood that in embodiments of the present technology, one or more of the steps may be performed manually.

Overview

An embodiment of the present invention relates to a system for monitoring an environment for a specific frequency band. The technology initially utilizes a micro-electromechanical system ("MEMS") based acquisition device to monitor an environment. The MEMS device receives a signal from the environment, and generates an input signal comprising an electronic representation of the received environmental signal. This input signal is then conditioned for at least one frequency band for which the system is configured to monitor. In one embodiment, the input signal is first sampled, such that a conditioning unit may perform a frequency check on a plurality of discrete samples associated with the input signal.

Another embodiment of the present technology relates to a prequalification stage for prequalifying the conditioned signal for a specific frequency range. After the MEMS acquisition device has detected an environmental input signal, the prequalification stage determines whether the environmental input signal might be categorized as one or more predefined events for which the system is monitoring. In one embodiment, a prequalification device implements a frequency check to determine whether the detected environmental signal oscillates within a specific, predefined frequency range that represents a characteristic frequency spectrum of a range of predefined events.

Yet another embodiment relates to a preliminary event processing system in which a detected environmental signal is identified to be the result of a single event among a group of predefined events. The system implements a process of event determination by comparing the characteristic peaks and frequencies of a conditioned input signal to those of a number of similar signals from the signal database. A event determination process yields an assessment of whether the detected environmental signal is similar enough to a predefined event from the signal database such that the signal may be classified as one of such predefined events. If such classification is warranted, then the event determination process identifies the specific event.

An alternative embodiment of the present technology implements a refined conditioning system where acquired data can be further conditioned so that specific attributes of a detected event can be identified. A bandpass filter is utilized to further condition the data for a specific and more refined frequency spectrum. A signal analysis converter then takes the conditioned data and converts it into a format that the system can efficiently and accurately analyze, and that can be easily viewed and mathematically represented for later analysis. A linear discriminate analysis module next acquires a waveform of the formatted data and digitally represents each of its component parts. Finally, a refined event detection process identifies one or more attributes associated with a detected event. In one embodiment, the proficiency of the refined event determination process of the refined conditioning system can be further increased by implementing a partial matrix that utilizes a set of trained data and calculates a specific degree of accuracy regarding identification by the system of an inputted signal as a specific event.

An event detection system according to principles of the present technology may be further configured to execute a specific response once an event determination process has taken place. This response may be predefined by a user, or otherwise determined on-the-fly such that the system decides the best method for responding to a detected event. In one embodiment, once an event is recognized, and its specific attributes identified, the environmental input signal is assigned an event ID for identification purposes. An alert triggering module then executes one or more predefined response operations that have been assigned to the identified event. The alert triggering module may be further configured to generate an output signal that communicates information relating to an identified event.

Reference will now be made in detail to more detailed embodiments of the present technology, examples of which are illustrated in the accompanying drawings. While the technology will be described in conjunction with various embodiments, it will be understood that they are not intended to limit the present technology to these embodiments. On the contrary, the presented technology is intended to cover alternatives, modifications and equivalents, which may be included within the spirit and scope the various embodiments as defined by the appended claims. Furthermore, in the following detailed embodiments, numerous specific details are set forth in order to provide a thorough understanding of the present technology. However, it should be understood by those skilled in the art that embodiments of the present technology should not be understood as being constrained by these exemplary details. Rather, the disclosed embodiments may be implemented in various fashions according to the needs of one practicing or implementing applications of the present technology.

Acquisition and Preliminary Conditioning

With reference to FIG. 1, a system 100 for monitoring an environment for an event according to an embodiment of the invention is shown. An environmental input signal 110 is produced by an event that occurs in the monitored environment. This environmental input signal may be any type of signal that is capable of being detected. For instance, in one embodiment of the present invention, the environmental input signal is a sound signal that resonates at a certain frequency. This characteristic frequency may be sonic, ultrasonic, subsonic, etc.; indeed, the sound signal may be audible or non-audible. The vibration of the environmental input signal need only be capable of being detected for the present embodiment to be practiced. According to another embodiment, the environmental input signal may be a light signal or visual image. A light signal itself has a characteristic frequency that is capable of being detected. For example, the frequency characteristics of a visible light signal are capable of being detected by the human eye, whereas the frequency of an ultraviolet (UV) light signal is capable of being detected by UV light detectors.

Referring still to FIG. 1, a signal acquisition device 120 is used to monitor the environment for an event. When an event occurs, the signal acquisition device detects the characteristic frequency of the environmental input signal 110, and converts the detected signal into an electronic input signal 130 that may later be processed by an electronic event detection system. This conversion process comprises the generation of an electronic input signal 130 that is an electronic representation of the frequency characteristics of the detected environmental input signal 110. The signal acquisition device 120 monitors the environment for a broadband, multi-frequency signal that is non-discriminate in nature.

In one embodiment of the invention, the signal acquisition device may be configured such that it selectively monitors an environment by being active for a certain period of time and then inactive for another period of time. Such a configuration may be accomplished by implementing a system timing device, such as a quartz, GPS or atomic clock. In this manner, the device may be cycled on and off depending on when a user wishes to monitor an environment. For example, a home security system implementing this embodiment of the invention could be configured to monitor for intruders only during the hours that the homeowner is generally away from home (e.g., during normal weekday work hours). The security system could be programmed to begin monitoring the environment at 7:30 a.m., and then cease monitoring at 5:30 p.m. Such an implementation of the present technology would conserve system resources (e.g., power, memory, etc.) between the hours of 5:30 p.m. to 7:30 a.m.

In another embodiment of the invention, the signal acquisition device 120 is a micro-electromechanical system ("MEMS") based acquisition device, as opposed to a traditional audio microphone or ultrasonic transducer. Whereas a traditional microphone is capable of detecting acoustic frequencies between 0 and 10 kHz, modern MEMS devices are capable of detecting between 0 and 100 kHz, and beyond, and in many cases, can succeed in doing so without adding much distortion. Theoretically, such devices are even capable of operating in the gigahertz range. Thus, MEMS devices are capable of acquiring ultrasonic sound, which is above the normal, audible sound range.

Indeed, many MEMS devices may be configured to acquire non-audio data, such as visual imaging signals. In one embodiment of the present invention, the acquisition of such visual imaging signals is combined with specific machine vision algorithms. For example, an image could be received by the MEMS device, and a first algorithm could be implemented to "clean-up" the image such that a foreground object can be better differentiated from the image's background. Then, a second algorithm could be implemented to analyze various features of a specific foreground object and compare them to attributes associated with an array of known objects in an object database. In this manner, a person skilled in the art could utilize this embodiment of the present technology for image recognition applications. For instance, the aforementioned example could be utilized by security personnel at an airport to monitor a specific terminal for certain high-profile individuals who might constitute a security threat. Yet another example is a security system that is configured to monitor for and recognize a characteristic shape of a specific weapon (such as a handgun).

The foregoing notwithstanding, modern MEMS technology also permits a signal to be acquired without injecting a relatively large degree of gain. To conceptualize the significance of this latter point, one might think of an electronic signal that is being transmitted between two points. Generally, when such a signal is transmitted, either wirelessly or via a transmission line, the signal is attenuated over time as a result of the characteristic impedance of the transmission line or ambient environment. Thus, when the signal is acquired at the receiving end, the signal must then be amplified so as to recreate the original signal as it existed before the undesired attenuation took place.

The problem with this process is two-fold: First, amplifiers do not selectively function depending upon what portion of a signal a user desires to be amplified. Thus, any noise that the signal acquired during the transmission process will be amplified as well. Secondly, amplifiers are plagued by a non-linear amplification characteristic that not only amplifies any noise that was acquired during the transmission, but which also injects an additional degree of distortion into the amplified signal. Thus, although modern amplifiers play an important role in "boosting" the strength of a received signal, they are mired by undesirable attributes with regard to signal processing applications. In contrast to past data acquisition devices which must be utilized in tandem with multistage amplifiers that can seriously distort a transmitted signal, modern MEMS technology permits a signal to be acquired without injecting a significant degree of gain. This translates into less noise overall, and less chance of inaccuracy regarding the original signal acquisition and subsequent event determination.

Figure 2:
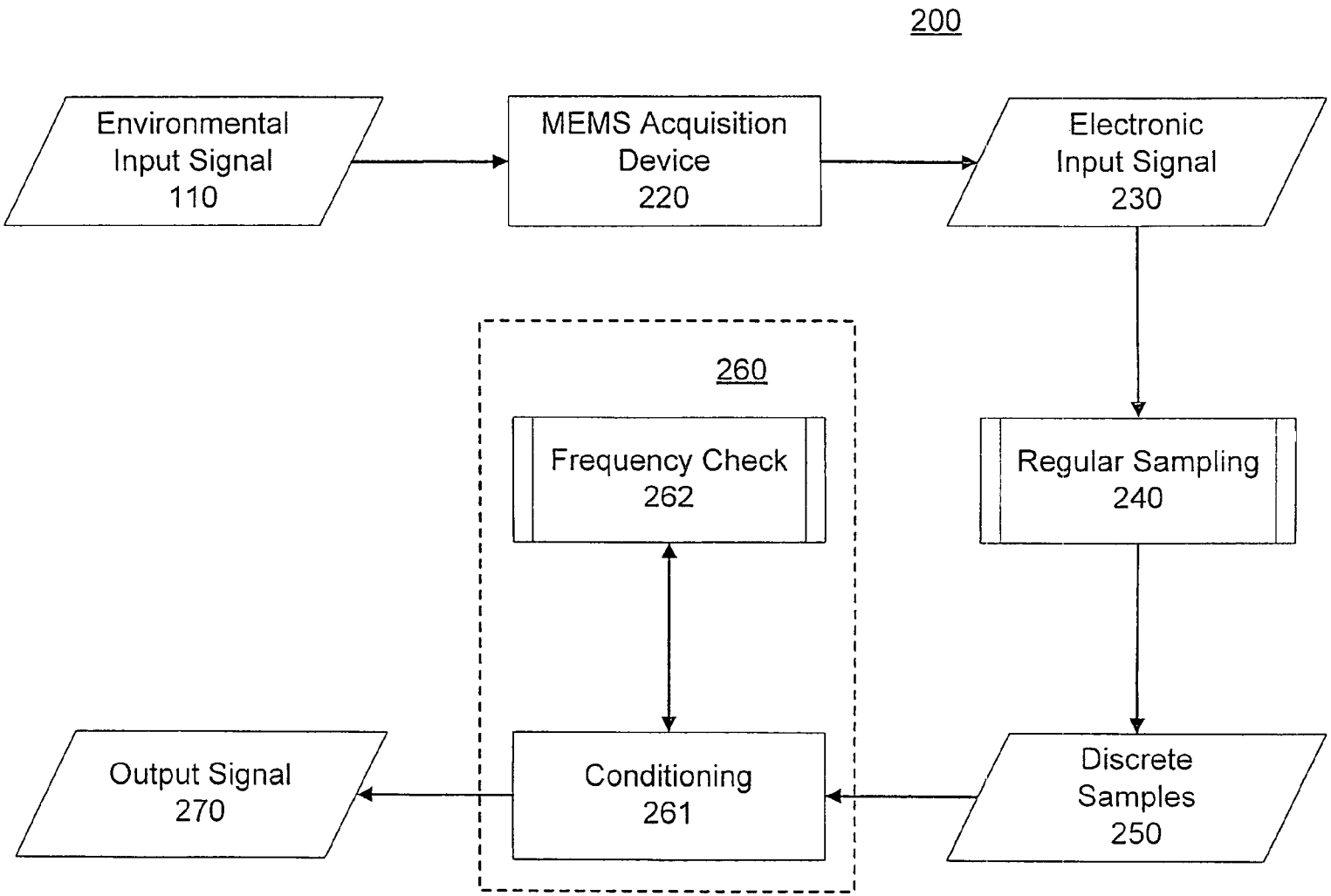
FIG. 2 is a block diagram of an exemplary system used in accordance with an embodiment of the present technology for acquiring and conditioning an input signal.

With reference now to FIG. 2, a system according to an embodiment of the present invention for acquiring and conditioning an input signal is illustrated. An environmental input signal 110 is produced by an event that occurs in an external environment. A MEMS based acquisition device 220 monitors the external environment for such an event. In one embodiment, the MEMS based acquisition device 220 operates in the 0 to 100 kHz frequency spectrum, but this range may be controlled and changed depending on the needs and the objectives of the user. For instance, a user may configure the MEMS based acquisition device so as to concentrate on a specific frequency range (such as may be used for gunshot detection, graffiti detection, or machine vision applications).

Upon detecting the environmental input signal 110, the MEMS based acquisition device 220 of FIG. 2 translates the detected signal 110 into an electronic input signal 230 that can then be conditioned for a specific frequency. The electronic input signal 230 is an electronic representation of the environmental input signal 110. That is, the electronic input signal 230 represents, in an electronic form, the frequency characteristics of the environmental input signal 110, such that these frequency characteristics may be analyzed and processed by the system 200. Thus, if the environmental input signal 110 is a sound signal comprising mechanical vibrations that are detected by the MEMS based acquisition device 220, these mechanical vibrations will be translated into an electronic format that can then be processed by the system 200.

Referring still to FIG. 2, the system 200 utilizes a predefined process of regular sampling 240 to acquire discrete samples 250 of the electronic input signal 230 at various points of the signal's 230 oscillation pattern. A first conditioning stage 260 is then implemented to condition the environmental input signal 110 for a specific frequency. The discrete samples 250 are transmitted to a conditioning device 261 that implements a predefined frequency check 262. The frequency check 262 is used to determine whether the detected environmental signal oscillates within a specific, predefined frequency range. Once the conditioning device 261 determines whether the environmental input signal 110 oscillates within a predefined frequency range for which the system 200 is monitoring, an output signal 270 is generated that can later be processed by the system 200.

Prequalification

Figure 3:
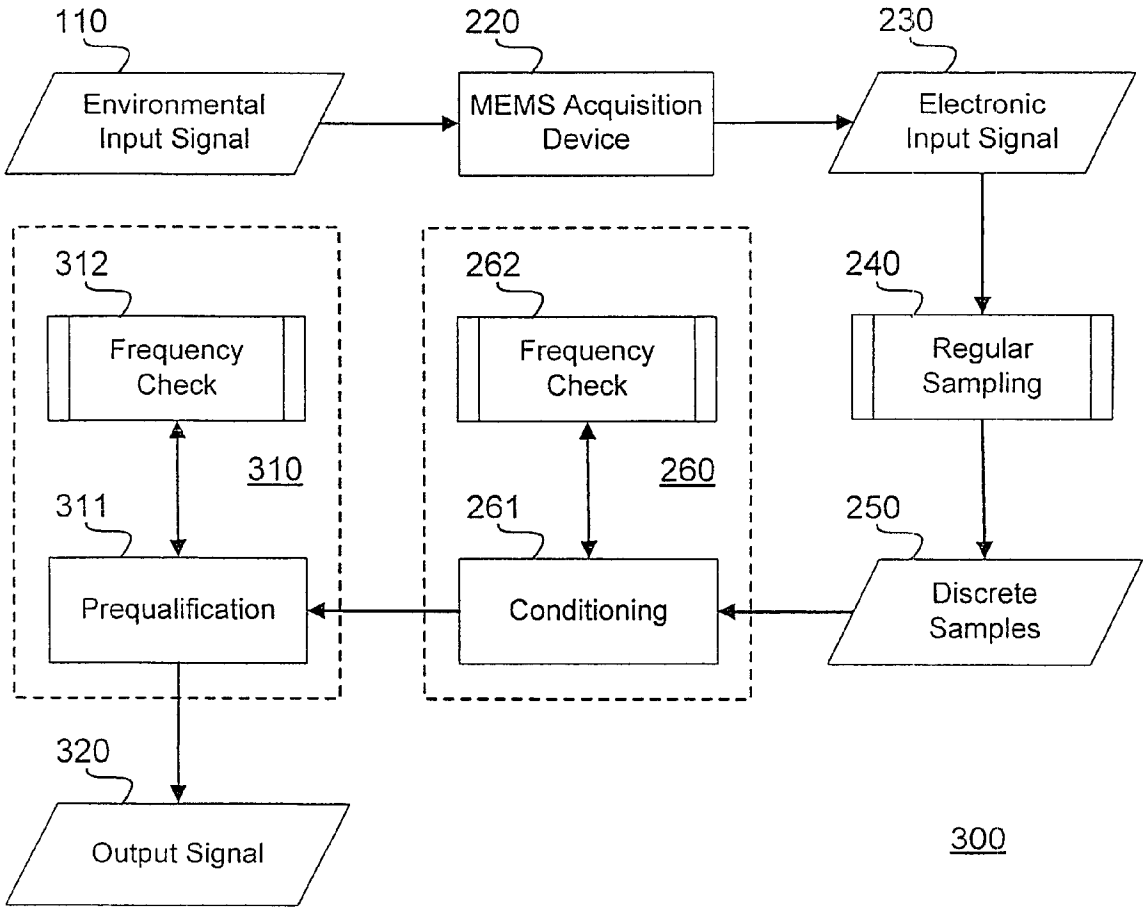
FIG. 3 is a block diagram of an exemplary system used in accordance with an embodiment of the present technology for prequalifying an input signal for a pre-defined event.

With reference to FIG. 3, a system 300 according to an embodiment of the present invention for prequalifying an input signal for a pre-defined event is shown. After the MEMS acquisition device 220 has detected an environmental input signal 110, the system 300 implements a prequalification stage 310 for determining whether the environmental input signal might be categorized as one or more predefined events for which the system 300 is monitoring. A prequalification device 311 implements a frequency check 312 to determine whether the detected environmental signal 110 oscillates within a specific, predefined frequency range that represents a characteristic frequency spectrum of a range of predefined events.

For instance, the engine of a truck, such as a tractor trailer used for transporting and/or distributing goods, may break down while the vehicle is in transit due to a faulty ball bearing, and while the ball bearing is relatively inexpensive, the damaged engine (as well as other damages resulting to the remainder of the vehicle, the driver and passengers, and the vehicle's cargo) may prove to be quite costly. In this example, an embodiment of the present technology could be configured such that the prequalification device 311 implements a frequency check 312 that focuses on the frequency characteristics associated with the acoustic sounds resulting from a faulty ball bearing. Thus, the system 300 could detect the presence of an error associated with such a ball bearing before damage is caused to the truck and engine, and this information could then be communicated to the driver. The driver could then immediately stop the vehicle and seek repairs.

There are certain characteristic peaks of signals detected in a broadband system. Different characteristic peaks will be indicative of different events (e.g. an aerosol spray can discharge used for creating graffiti may create an acoustic sound in the range of 45 to 50 kHz). However, prequalification is not limited to a frequency check. For example, an image check could also be implemented wherein various machine vision techniques and algorithms are implemented so as to check for a specific predefined image. In one embodiment, sound may be inputted into the prequalification device 311 and additionally qualified with other sources of data or data types (e.g., temperature, humidity, light/darkness, motion and/or imaging, etc.). For example, an embodiment of the present technology could be implemented wherein an acoustic frequency check for a faulty ball bearing is initiated only when a vehicle is in motion. This would seem to make sense as far as system functionality is concerned, because a faulty ball bearing will generally only create a noise when the vehicle is moving as opposed to when the vehicle is parked.

Thus, in this latter embodiment, the system 300 may be configured so as to add as much additional information and data as is desired for the user's objectives. The prequalification device 311 implements a frequency check 312 to determine whether the detected environmental signal 110 should be categorized as one or more predefined events for which the system 300 is monitoring. After the prequalification stage 310 has finished processing a signal, the system 300 generates a prequalified output signal 320 that may later be processed by the system 300 for purposes of refined event determination. Pursuant to one embodiment, if the prequalification device 311 does not successfully prequalify an event, the device 311 yields a system null which resets the prequalification system 300, and the MEMS based acquisition device 220 continues to monitor for an event.

Preliminary Event Processing and Data Storage

Figure 4:
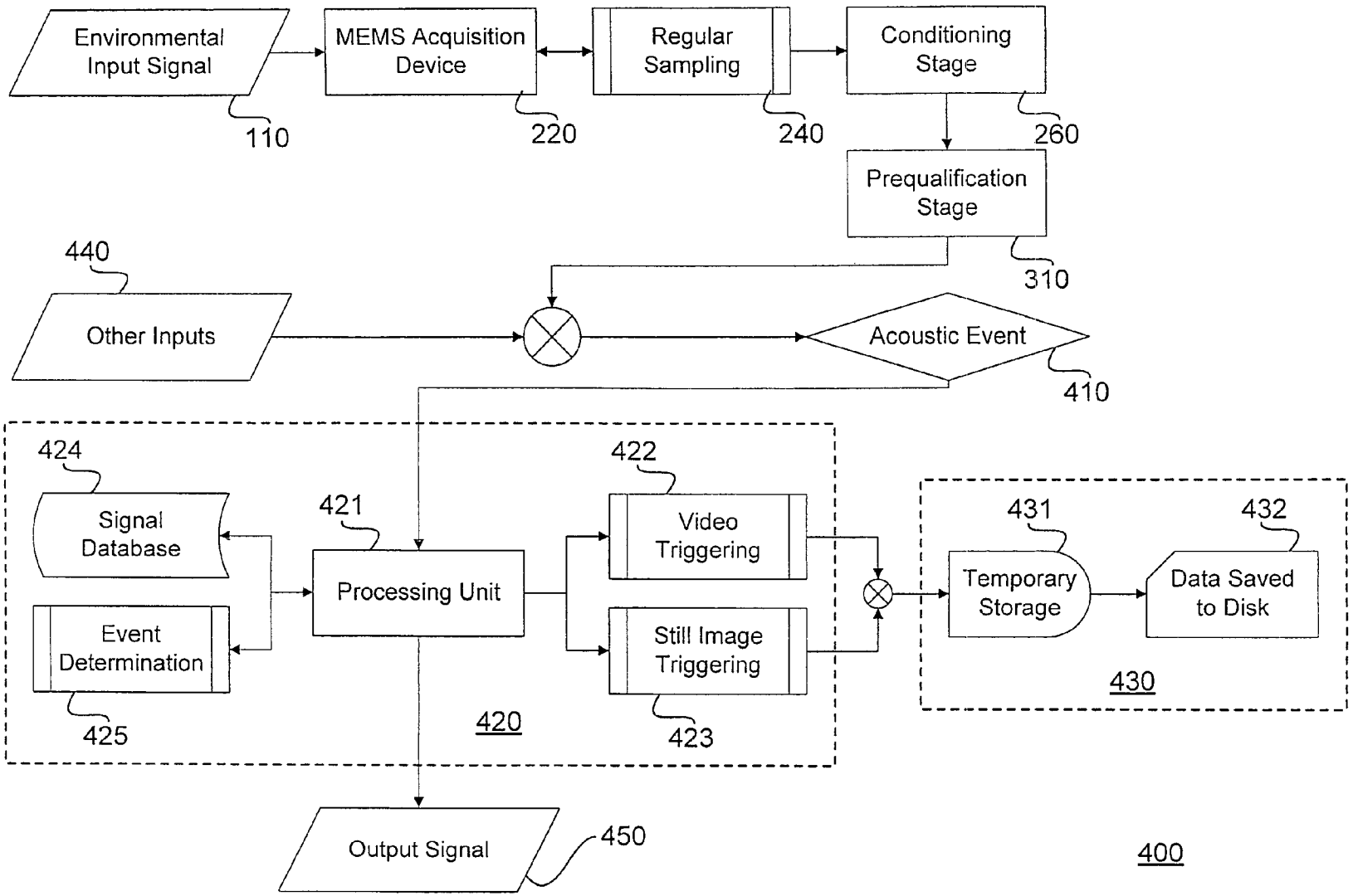
FIG. 4 is a block diagram of an exemplary system according to an embodiment of the present technology wherein a prequalified signal is determined to be a specific pre-defined event.

With reference now to FIG. 4, a system 400 according to an embodiment of the present invention for processing a prequalified signal for purposes of event determination is shown. After the input signal 130 has been conditioned and prequalified for a specific frequency range, the system 400 determines 410 whether the environmental input signal 110 is the result of an acoustic event. The system 400 next implements a preliminary processing stage 420 for purposes of preliminary event determination. A processing unit 421, such as a microprocessor configured for event processing, executes video triggered 422 and still image triggered 423 processing events.

The processing unit 421 in FIG. 4 compares data to a known database 424 of similar signals, which correspond to predefined events. The preliminary processing unit 421 then carries out a process of event determination 425 by comparing the characteristic peaks and frequencies of a conditioned signal to those of a number of similar signals from the signal database 424. The event determination process 425 yields an assessment of whether the conditioned signal is similar enough to a predefined event from the signal database 424 such that the environmental input signal 110 may be classified as having resulted from one of such predefined events. If such a classification is warranted, then the event determination process 425 identifies the specific event that the input signal 110 has been identified as by the system 400. Thus, the system 400 does not simply output a binary response (e.g., that a discharge from a spray canister was or was not identified). Rather, the system 400 discretely identifies specific attributes of the event that has been identified (e.g., that a detected spray canister is an aerosol spray can).

Subsequent to processing 420, the system 400 generates an output signal 450 that comprises the results of the event determination process 425. Thus, the output signal communicates the specific event that has been identified, or that no event was determined to have transpired in the monitored environment if the system 400 determines that no such event has occurred. In one embodiment, if an event is not qualified, the system 400 continues to monitor the environment for a predetermined event (i.e., the entire process cycles back and begins again).

Referring still to FIG. 4, a prequalified signal may be analyzed together with other input signals 440. These other input signals 440 need not be acquired by the same MEMS based acquisition device 220, as different inputs can have their own parallel channels in the system 400. In one embodiment of the invention, logic (e.g. AND/NAND technology) may be used in combination with the prequalification technology such that multiple required events must be present in order for the process to continue. In another embodiment, the qualification of one input is dependent upon the qualification of another input. This latter application offers great utility regarding early event detection systems. For instance, if a specific sound is detected (e.g. aerosol spray can discharge), the system can then concentrate its efforts on monitoring for a specific image (e.g. a human form present in the area of interest). This provides an example of how one skilled in the art might implement the present technology to quickly identify and deter certain undesirable events (in this case, graffiti).

In another embodiment, the present technology could be implemented as an event detection security system in which the qualification of one input is dependent upon the qualification of another input. For instance, the system 400 could be configured such that selective monitoring occurs between dusk and dawn, and such that infrared motion as well as certain predefined sounds must be present in order for an event to be identified, and a particular task carried out.

Pursuant to one embodiment, when the event determination process 425 identifies a particular predefined event (e.g., the possible presence of a burglar) for which the system 400 is configured to monitor, the system sounds an alarm to alert a user of the identification of the predefined event. For example, if the system 400 identifies what may be a burglar breaking into a dwelling, the system 400 then notifies a user, such as the owner or an inhabitant of the dwelling, by sounding an audible alarm configured to be heard by a human being. In an alternative embodiment, the system 400 is coupled to a communication network and configured to automatically notify the police when the presence of a potential burglar is detected.

In addition to the aforementioned examples, another embodiment provides that the system 400 may be configured to carry out a different task once the event determination process 425 identifies a particular predefined event. For example, if the presence of a potential burglar is detected, the system 400 could be configured to turn on one or more lights, such a light located in the vicinity of any detected motion associated with the detected event. Thus, in the event that a burglar is detected near a dwelling, the system 400 could be configured to turn on a group of outside lights to scare the burglar off or notify others, such as occupants and neighbors of the dwelling, of the detected event. According to an alternative embodiment, the system 400 may be configured to automatically take an action to incapacitate an identified threat. For example, if the system 400 detects a person scaling an electric fence, the system 400 would automatically turn on or adjust the current being driven through the fence in order to temporarily incapacitate the person.

In another embodiment, the system 400 is configured to automatically lock one or more entrances to a structure when the presence of a potential burglar is detected. For example, the system 400 could be implemented in an office building having doors and windows that may be electronically locked, and wherein the system 400 is configured to monitor for potential prowlers. If the system 400 identifies what may be a potential prowler, the system 400 automatically locks the building's doors and windows. In one embodiment, the system 400 may be further configured carry out other operations. For example, the system 400 could be configured to access a communication network and send a message to one or more security personnel that a potential prowler has been detected. The sent message could include one or more attributes associated with the event, such as the location of the building, where precisely the event was detected, contact information for certain persons of interest (e.g., the owner or lessee of the building), or directions for the recipient of the message. For instance, upon detecting the presence of a potential prowler, the system 400 could send an electronic message that directs a security guard to immediately contact the police, relay the message to the police, and then proceed, with caution to the specific location where the event was detected.

With reference still to FIG. 4, the system 400 may be further configured to implement video triggered 422 and still image triggered 423 events for processing data associated with detected images and motion. For instance, the processing unit could be configured to execute a begin video operation in response to a received input signal, wherein the begin video operation cause a video clip to be captured 400 by the system. Then, the video triggered event 422 would analyze movement of a foreground object present in the captured video clip. Similarly, the still image triggered event 423 could be configured to analyze physical attributes associated with a foreground image located in a captured still image.

In one embodiment, the system 400 is configured to detect the presence of a potential threat in an area of interest and automatically respond to the potential threat. For example, the system 400 could be configured to monitor for certain images and motion in an area that surrounds a military installation. If the system 400 identifies a gunshot coming from a specific direction, the system 400 analyzes the output of the video triggered 422 and still image triggered 423 events in order to determine the direction from which the shot was fired. Indeed, in another embodiment, the system 400 is coupled to a firearm that may be electronically triggered, and the system 400 is further configured to automatically return fire when the direction of a detected gunshot has been identified.

With reference again to FIG. 4, another embodiment of the present technology teaches that the results of the video triggered 422 and still image triggered 423 events are saved into storage 430 so that they may be subsequently retrieved by the system 400. The results of these events 422, 423 are first stored in a temporary storage unit 431, and next transmitted to a permanent storage unit 432 for long term storage applications. The system storage 430 serves a dual purpose: First, it allows the system 400 to later retrieve these results in order to conduct further processing and/or conditioning of an acquired signal. Second, it allows for the option of providing further training to the system 400 (i.e., an active learning process may be implemented, which in the long run, can increase overall system efficiency and performance). This can allow the system 400, in the future, to quickly identify events that are similar to the specific predefined events that the system 400 was originally configured to identify.

For example, the system 400 could be configured to monitor for gunshot sounds, and upon hearing a firecracker, the system would initiate the conditioning and prequalification stages 260, 310. Although unlikely, if the sound of the firecracker resonates at a frequency that is similar to a gunshot for which the system is monitoring, then the input signal 110 will satisfy the prequalification stage 310. Once the firecracker is determined to be an acoustic event 410, the system 400 initiates the preliminary processing stage 420, wherein the event determination process 425 determines that the acquired environmental input signal 110 (i.e., the sound of the firecracker) does not share the same exact frequency characteristics of any event in the signal database 424.

With reference to the same example, the system 400 can next classify the environmental input signal 110 as an event of interest for future analysis, and then store the attributes of the environmental input signal 110 into the system storage 430. In this manner, the system 400 will be able to compare subsequently acquired signals to the saved attributes of the environmental input signal 110 in order to increase the efficiency of the event determination process 425. Such heuristic methods of implementation would provide a long term benefit to the system 400, because there would be a greater probability of less false positives. The system 400 would be able to quickly identify a newly acquired signal as being a product of the event of interest and not among any pre-defined events from the signal database 424.

Embodiments of the present invention can also be configured to store in memory a specific amount of inputted data (e.g., 20 seconds, 30 seconds, etc.) depending on how much data needs to be captured for adequate event analysis, and depending on when the data needs to be captured. For example, an embodiment of the present technology could be implemented for highway patrol purposes in which a speed detection system is equipped with two data acquisition devices. A first data acquisition device could comprise radar device used to determine the velocity of a vehicle traveling at a certain point on a monitored highway. The system 400 would be configured to trigger a MEMS based acquisition device 220 if the determined velocity exceeds a particular threshold (e.g., 75 miles per hour). The MEMS based acquisition device 220 would then input visual data relating to the vehicle for the next twenty seconds, and the twenty seconds of data would be stored into memory 430 for later analysis. Indeed, the system 400 in this example could be further configured such that the video triggering 422 or still image triggering 423 processes automatically trigger the storing of the captured data. In this way, the captured video footage could be subsequently scrutinized in order to determine specific information about the speeding vehicle and its driver.

In another embodiment, such temporally expanded data capture and storage would also allow the system 400 to assess background changes such that the system 400 can more quickly and proficiently qualify an event. For instance, the system could be configured to capture and store visual and audio data and simultaneously monitor for an acoustic event. In one example, if someone walks up and starts "tagging" a surface with an aerosol paint can, the event would not be confined to when the spraying began (in which case the perpetrator's face may or may not still be visible). Rather, the system 400 could analyze 20 seconds of data captured previous or subsequent to the detected event such that there is a higher probability of capturing an image of the perpetrator's face for subsequent identification purposes. As a second example, if a gunshot is detected, the system 400 could analyze 20 seconds of data captured previous or subsequent to the detected event such that there is a higher probability of capturing data that may be utilized by the police to identify the person who fired the shot, such as a vehicle license plate, identifying features of a person of interest (e.g., the perpetrator or a witness), a name being shouted, etc.

In an alternative embodiment, the system 400 is configured to control an adjustable lighting system located in the vicinity of a monitored environment in order to adjust the quality and usefulness of captured data. When the system 400 detects an event, it adjusts the lighting in a monitored environment and captures subsequent visual data. For example, when the system 400 detects an event, such as the spraying of an aerosol can, the system 400 can simultaneously obtain, record and analyze visual imaging data intended to obtain more information about an object of interest in the monitored environment (e.g., a perpetrator's facial features). If a different lighting setting is required in order to adjust the quality of the captured data, the system will adjust the lighting in the monitored environment accordingly. New visual data will then be captured and recorded into memory, and this new data will itself be analyzed. The system will continue to adjust the lighting and record new data until quality data has been obtained that may be adequately processed, or until the object of interest is no longer present in the monitored environment.

Refined Conditioning

Figure 5:
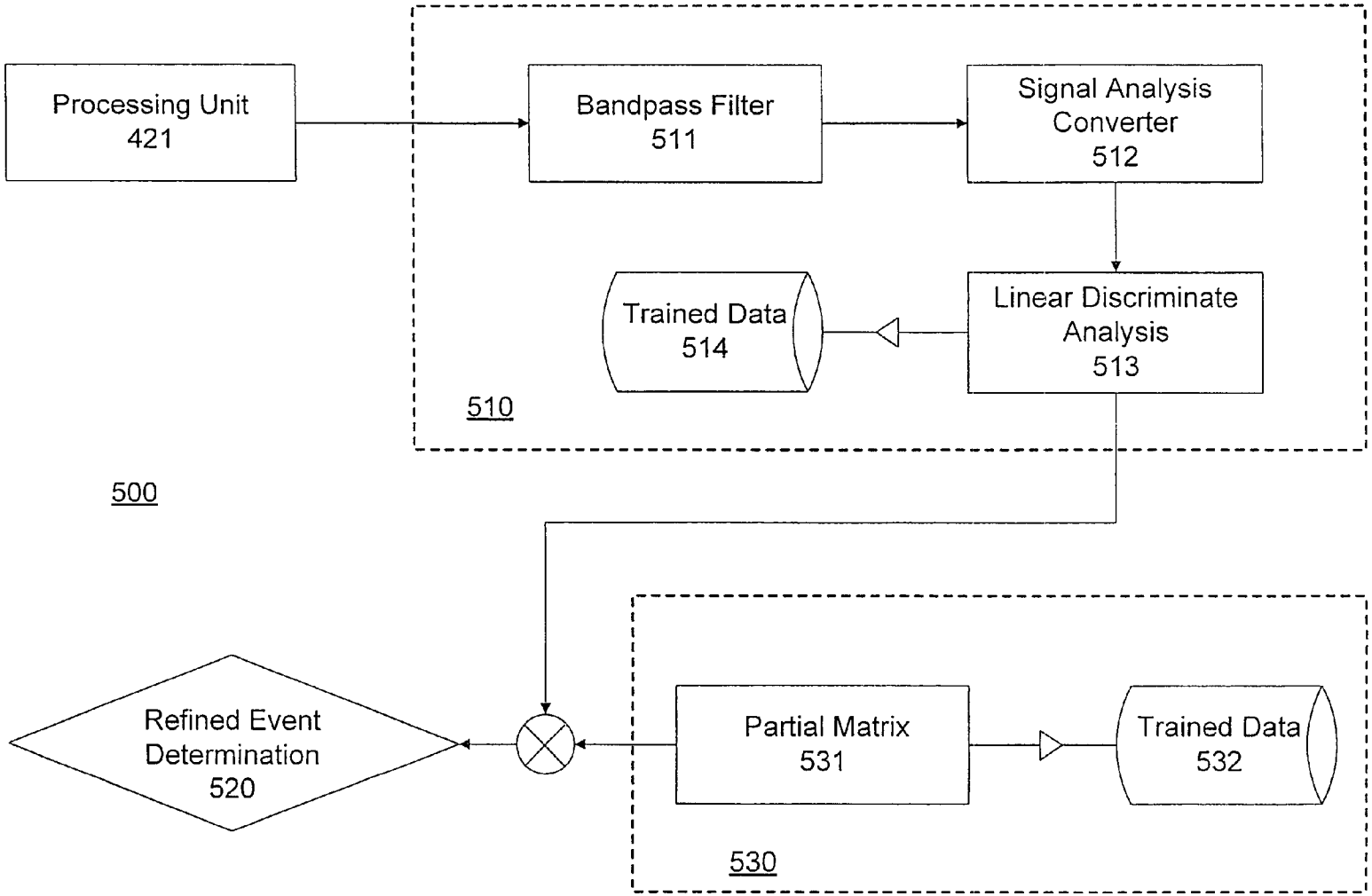
FIG. 5 is a block diagram of an exemplary system according to an embodiment of the present technology wherein a first conditioning stage is combined with a second conditioning stage.

With reference now to FIG. 5, a refined conditioning system 500 for further conditioning an input signal is shown. Upon completion of a preliminary conditioning process, the acquired data is forwarded to the refined conditioning system 500 where the data is further conditioned such that a refined conditioning process 520 can identify one or more specific attributes associated with an identified event. For instance, subsequent to conditioning a signal for a specific frequency spectrum and determining that the signal is most likely associated with a gunshot, the bandpass filter 511 could be configured to further condition the signal such that the system 500 can more accurately identify the caliber of firearm that fired the round. In this manner, the preliminary event processing system 400 of FIG. 4 may be coupled to the refined conditioning system 500 of FIG. 5 so as to identify more specific information associated with an event.

In the embodiment illustrated in FIG. 5, the processing unit 421 forwards the acquired data to a first conditioning stage 510 where a bandpass filter 511 further conditions the data for a specific frequency spectrum. The bandpass filter 511 isolates a specific portion of the inputted data that is of most interest to the system 500, which increases the efficiency of the processing time and the capacity of the system 500 to process subsequent events. For example, the bandpass filter 511 could be configured to isolate the frequencies of the signal that correspond to discharges associated with various handgun rounds (e.g., .38, .357, .40, .45, etc.). The system 500 will then be able to process these isolated frequency characteristics in a more efficient manner, because it will not need to process data that is not of interest to the refined event determination process 520.

In the embodiment illustrated in FIG. 5, a signal analysis converter 512 takes the conditioned data and converts it into a format that the system 500 can efficiently and accurately analyze, and that can be easily viewed and mathematically represented for later analysis. In one embodiment, the signal analysis converter implements a Fourier transform algorithm such that the system 500 can analyze this data in a frequency domain. Such refined conditioning aids the system 500 to recognize certain patterns in the frequency characteristics of inputted data, which ultimately aids in the refined event determination process 520.

In an alternative embodiment, the signal analysis converter 512 implements a Gabor wavelet transform for purposes of image recognition. For instance, the system 500 could be implemented to process visual data associated with a captured image of a person's face. The Gabor wavelet transform would provide a means of achieving a more refined image analysis. Specifically, the implementation of a Gabor wavelet transform would provide the system 500 with a means of mathematically identifying unique instances of action occurring at specific frequencies among distinct points of an analyzed waveform. This is in contrast to many modern Fourier transform algorithms, which are oftentimes limited to simply identifying which frequencies are present in a waveform without a more refined analysis being instituted.

Referring still to FIG. 5, a linear discriminate analysis module 513 acquires a waveform of an inputted signal and digitally represents each of its component parts. In one embodiment of the present invention, the linear discriminate analysis module further generates a histogram representation of the entire sequence of such component parts that may then be analyzed by a user. The linear discriminate analysis module generates X number of samples, which can then be analyzed in N number of dimensions, thus creating an Nth-dimensional "trend line." In another embodiment, subsequent samples are generated within a predefined number milliseconds or microseconds. The greater the number of samples and dimensions utilized in the analysis, the greater will be the degree of accuracy that the system 500 can realize in the pattern recognition process.

For example, in order to increase the degree of accuracy of the refined event determination process 520, the linear discriminate analysis module 513 could be configured to generate a sample of a gunshot signal every 100 microseconds as opposed to every 10 milliseconds (thus increasing the number of samples by a factor of 100). As a result, the system will have more pertinent data at its disposal during the refined event determination process 520 because the system will have generated a greater number of samples. In addition, rather than simply analyzing the frequency characteristics of the gunshot as a function of time, the system 500 could be further configured to analyze the frequency characteristics both as a function of time and air pressure. An increased number of processing dimensions would enable the system 500 to implement processing algorithms that are more complex, and would provide the refined event determination process 520 with a more comprehensive backdrop with which to conduct its analysis. In the present example, the event determination process would be able to take into account the effects of air pressure on the discharge of a firearm (for instance, an increased level of air pressure may prove to squelch the sound of a gunshot to a certain degree).

However, it should be understood by those skilled in the art that when the linear discriminate analysis module 513 generates an increased number of samples, and when the system 500 implements a greater number of processing dimensions, overall system processing is consequently increased because more data must be processed by the system 500. To illustrate, the speed with which a modern day computing system can process data is dependent on the processing speed of its processing unit (e.g., a computer's microprocessor). Thus, if a computer utilizes an increased number of samples and dimensions when processing data, the speed with which the computer processes the data will inevitably decrease since the requisite amount of overall system processing will increase accordingly. One embodiment of the present invention accounts for such limitations of modern day computing systems by allowing a user to control the amount of data that the system 500 utilizes to process an event. For instance, the linear discriminate analysis module 513 may be configured to take more or less samples of the waveform depending on the degree of accuracy and amount/speed of processing that a user desires. This provides for a greater degree of extensibility regarding implementation of the system 500 for processing different events under different conditions, in which varying processing speeds may be required.

Referring still to FIG. 5, the linear discriminate analysis module 513 obtains trained data 514 to confirm the occurrence of a specific event type. In one embodiment, the trained data 514 may be updated to include new information. For example, the system 500 could be configured to communicate with a remote database containing event information not found in the trained data 514. This new information would then be transferred, uploaded, downloaded or copied to the trained data 514 such that the information that is available to the linear discriminate analysis module 513 is updated. Indeed, the system 500 could be configured to periodically query a remote database to determine if new information is available, and to automatically download such new information to update the trained data 514. This would increase the efficiency with which the system 500 can identify attributes associated with identified events, since the trained data 514 would be comprised of a greater amount of information regarding possible event attributes.

In another embodiment, if the linear discriminate analysis module 513 is unable to identify a specific attribute associated with an identified event, the system 500 is configured to communicate with a remote database to determine if new information regarding the identified event is available. For example, the system 500 could be configured to couple to a communication network through which a server accesses one of a plurality of databases, and forwards new information regarding an event attribute to the system 500. In another example, the system 500 could be further configured to automatically download new event information when a specific attribute cannot be identified, thus allowing the system 500 to heuristically update its breadth of knowledge regarding the number and type of possible event attributes.

In an alternative embodiment of the present technology, the system 500 is configured to communicate with a second event processing system. For instance, if the system 500 is unable to identify a specific event attribute, the system 500 could be configured to automatically forward, through a transmission line or wireless data connection, the conditioned data to the second system, which may be located remotely. Upon receiving the forwarded data, the second system would then process the data and determine if a specific attribute can be identified. If such an attribute is identified, the second event processing system would forward its results to the refined conditioning system 500. Thus, it should be understood by those skilled in the art that the efficiency and efficacy of various embodiments of the present technology may be increased by implementing various heuristic methods of data processing, or by utilizing a plurality of event processing systems or information databases in tandem.

With reference still to FIG. 5, the proficiency of the refined event determination process 520 of the refined conditioning system 500 of FIG. 5 can be further increased by implementing a partial matrix 531, such as a Fischer partial matrix. This partial matrix 531 utilizes a set of trained data 532 and calculates a specific degree of accuracy regarding identification by the system 500 of an inputted signal as a specific event. For example, once an event has been identified as a gunshot, the partial matrix 531 could be implemented to determine the highest probability that the gunshot was the result of a specific caliber firearm.

In another embodiment of the present invention, a user can specify a desired degree of accuracy (e.g., a specific number of standard deviations) that the system 500 must operate within. For instance, the system 500 could be configured such that it operates within three standard deviations, which yields a high degree of accuracy regarding the output of the refined event determination process 520, but which saves the system 500 from continued processing iterations that would degrade system performance. Thus, in this example, a user could decide to settle for 98% accuracy rather than 99% accuracy in order to speed up the processing cycle.

In one embodiment, the system 500 may be configured to operate with an even smaller degree of accuracy. For instance, less accuracy may be desired so as to avoid filtering out a possible event that might actually have occurred, but where the inputted signal was unintentionally distorted or degraded by bugs present in the actual implementation or configuration in the system 500. For instance, a manufacturing flaw in a transmission line that is used to send data between two points in the system 500 might cause the line to have a relatively high level of internal impedance, which could degrade an acquired signal. By operating with a smaller degree of accuracy, the degradation of the acquired signal will not cause the refined event determination process 520 to be fooled into thinking that the acquired signal is unrelated to a specific, predetermined event.

The foregoing notwithstanding, by implementing a higher degree of accuracy that the system 500 must operate within, a user might inadvertently degrade the ability of the system 500 to identify similar events that have relatively miniscule differences in their respective frequency characteristics. For example, under certain environmental conditions, the discharge of a .40 caliber round might sound confusingly similar to that of a .45 caliber round. Thus, there may be times when a user might prefer a false positive to completely eliminating a possible event choice during the event determination process. In this example, if a .40 caliber round is fired, but, for whatever reason, it sounds like a .45 caliber round, the system 500 might eliminate the possibility of a .40 caliber round as a possibility during the refined event determination process 520. However, the system 500 could be configured to operate with a smaller degree of accuracy such that events relating to the discharge of both .40 and .45 caliber rounds are determined to be event possibilities.

In another embodiment, the trained data 532 comprises an average of frequency characteristics of similar events that the partial matrix 531 takes into consideration. For example, a portion of the trained data 532 relating to gunshot events could comprise an average of twenty shots fired from each of a plurality of different model firearms, and where each of the fired rounds is of the same caliber, but is fired under different conditions (e.g., during a clear day versus in the middle of a rainstorm). This would allow the partial matrix 531 to consider the effects of further event parameters so as to increase overall system accuracy. For instance, in the aforementioned example, the partial matrix 531 would be able to consider how varying weather conditions affect the sound of a gunshot of a specific caliber round that is fired from a particular firearm of interest.

Pattern Recognition and System Response

Figure 6:
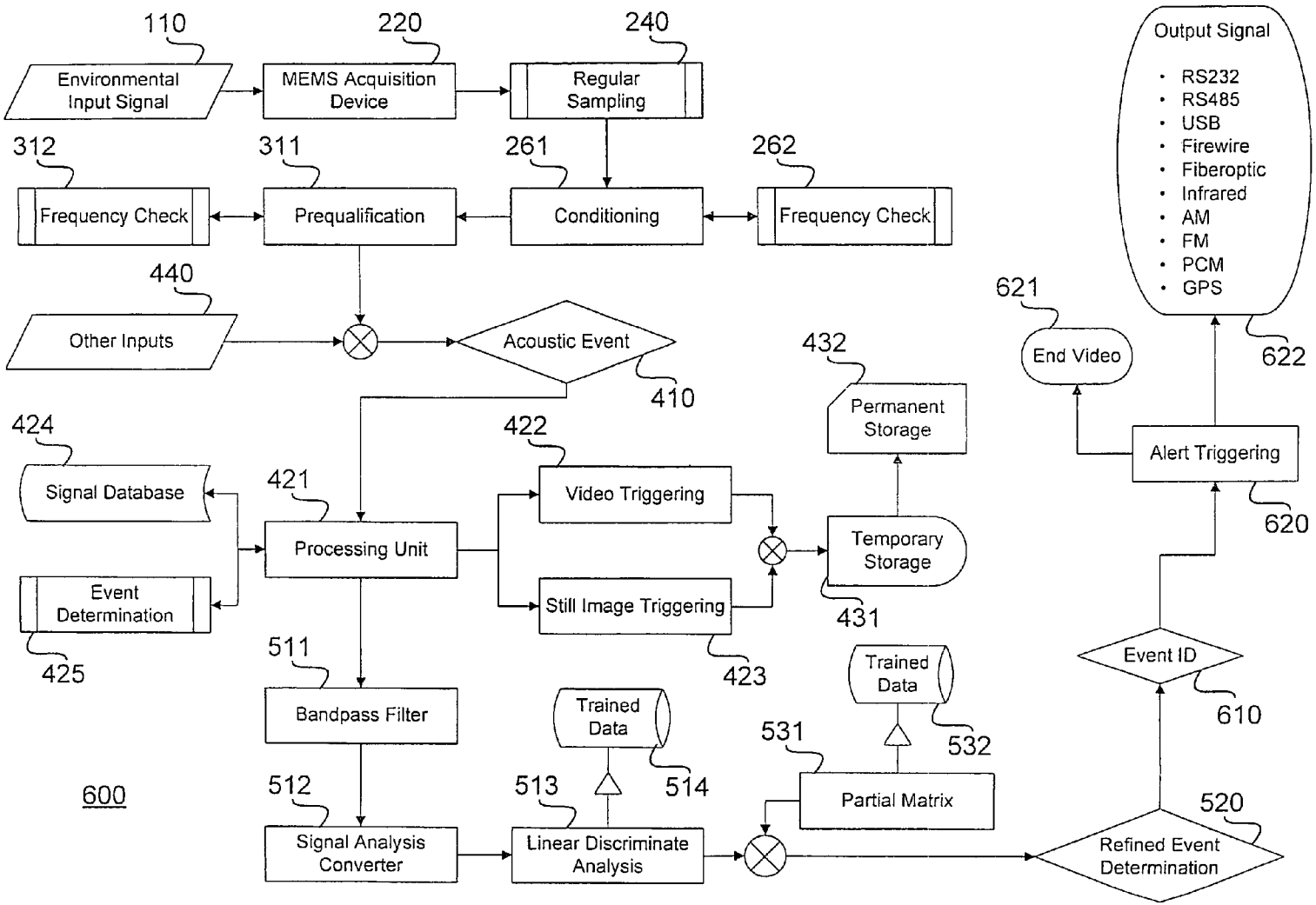
FIG. 6 is a block diagram of an exemplary system according to an embodiment of the present technology that demonstrates possible system responses resulting from the event determination process.

With reference now to FIG. 6, an embodiment of the present invention is illustrated wherein an integrated system 600 is configured to respond once the refined event determination process 520 has taken place. Once an event is recognized, and its specific attributes identified, the environmental input signal 110 is assigned an event ID 620 for identification purposes. An alert triggering module 620 then executes one or more predefined response operations that have been assigned to the identified event. For instance, in the illustrated embodiment, the alert triggering module executes an end video operation 621 that causes a specific video feed to terminate; in this way, the system 600 can be configured to execute the end video operation 621 for purposes of implementing a selective monitoring process. In this way, video data is captured only during selected times according to a user's particular needs, and precious system storage 431, 432 is conserved.

In another embodiment, the alert triggering module generates an output signal 622 that can subsequently be transmitted to a remote receiver. For instance, the output signal 622 could be transmitted to either a local or remote alarm system that is used to alert others as to the occurrence of the detected event. However, it should be understood by those skilled in the art that the output signal 622 may be transmitted by means of a number of output options. Such output options include, but are not limited to, RS232, RS485, USB, firewire, fiber optic, infrared, AM, FM, PCM, GPS, and similar communication technologies.

Thus, when the refined event determination process 520 has successfully identified one or more attributes associated with the detected event, the system 600 may implement the output signal 622 to communicate such information. For instance, if the system has identified a gunshot as being a detected event, and if the refined event determination process 520 has identified the gunshot as being the result of a firearm firing a .40 caliber cartridge, the system will generate the output signal 622 communicating that a .40 caliber round has been discharged in the monitored environment. However, in another example, if the refined event determination process 520 is unable to identify an attribute of a detected event, such as the specific round of a detected gunshot, the system 600 will simply identify the detected event (e.g., the output signal 622 will be used to communicate that a gunshot was detected, but that the system 600 was unable to identify the specific caliber of the round fired).

In an alternative embodiment, if the refined event determination process 520 is unable to identify an attribute of a detected event, the output signal 622 communicates one or more possible attributes that might be associated with detected event. For instance, if a gunshot is detected, and if the refined conditioning system 500 is able to determine that either a .40 or .45 caliber round may have been fired, the output signal 622 can be configured to communicate both of these possible event attributes. In this manner, even if a specific attribute of the detected event cannot be identified, a user will still receive valuable information relating to a range of attribute possibilities.

Operation

Figure 7:
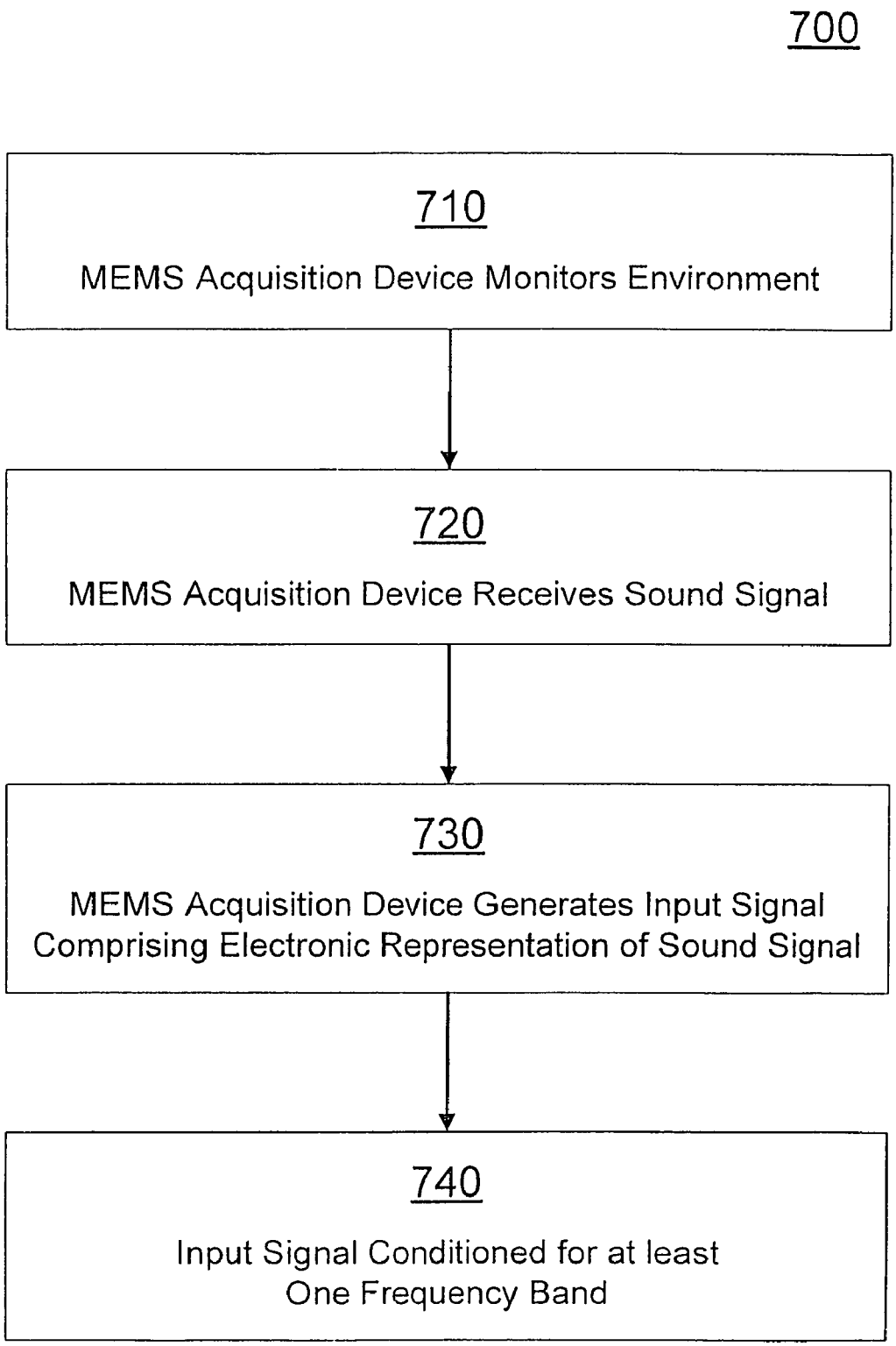
FIG. 7 is a flowchart of an exemplary method for monitoring for a specified frequency band in accordance with an embodiment of the present technology.

With reference now to FIG. 7, an exemplary method 700 for monitoring for a specified frequency band according to an embodiment of the present invention is shown. The method 700 comprises utilizing a micro-electromechanical (MEMS) based acquisition device is to monitor an environment 710, and receiving a sound signal at the MEMS based acquisition device 720. The method 700 further comprises generating an input signal at the MEMS based acquisition device 730, wherein the input signal comprises an electronic representation of the sound signal, and conditioning the input signal for at least one specific frequency band 740. In one embodiment, an input signal received at the MEMS based acquisition device is conditioned within at least one specific frequency band to provide a refined version of the input signal for future analysis.

The method of FIG. 7 can be expanded so as to include other data acquisition and processing operations, depending on the needs and objectives of a user. For instance, in one embodiment, the MEMS based acquisition device is powered by means of an electrical power source. This electrical power source may comprise an internal power source, such as a system battery, or an external power source, such as a transmission line that delivers alternating current and that may be accessed through an electrical wall socket. However, when the MEMS based acquisition device is powered by means of an internal power source (e.g., a system battery), the method of FIG. 7, according to the present embodiment, comprises providing power to the device only during specific periods of time such that the MEMS device is selectively powered up and selectively powered-down to extend the device's battery life. Similarly, in an alternative embodiment, the method of FIG. 7 comprises selectively powering the MEMS based acquisition device such that the MEMS device selectively monitors an environment.

With reference still to FIG. 7, the method can be further expanded so as to include the step of utilizing the MEMS based acquisition device to monitor an environment for frequencies ranging from 0 kHz to 100 kHz. This would essentially fine tune and configure the MEMS device for broadband monitoring applications. In the case of firearm detection, this latter step could be further configured so as to select a range of frequencies that include gunshot sounds that resonate within at least one frequency band from within the frequencies ranging from 0 kHz to 100 kHz that are monitored by the MEMS based acquisition device.

However, if a user wished to implement the method of FIG. 7 for purposes of graffiti detection, the method could be expanded so as to include the step of selecting a range of frequencies that includes spray can discharge sounds that resonate within at least one frequency band from within the frequencies ranging from 0 kHz to 100 kHz monitored by the MEMS based acquisition device. Indeed, in one embodiment, the method of FIG. 7 may be utilized for security applications configured to monitor for gunshot sounds and also detect graffiti. Thus, the method of FIG. 7 may be expanded so as to allow the MEMS based acquisition device to concentrate its efforts on more than one frequency spectrum.

Figure 8:
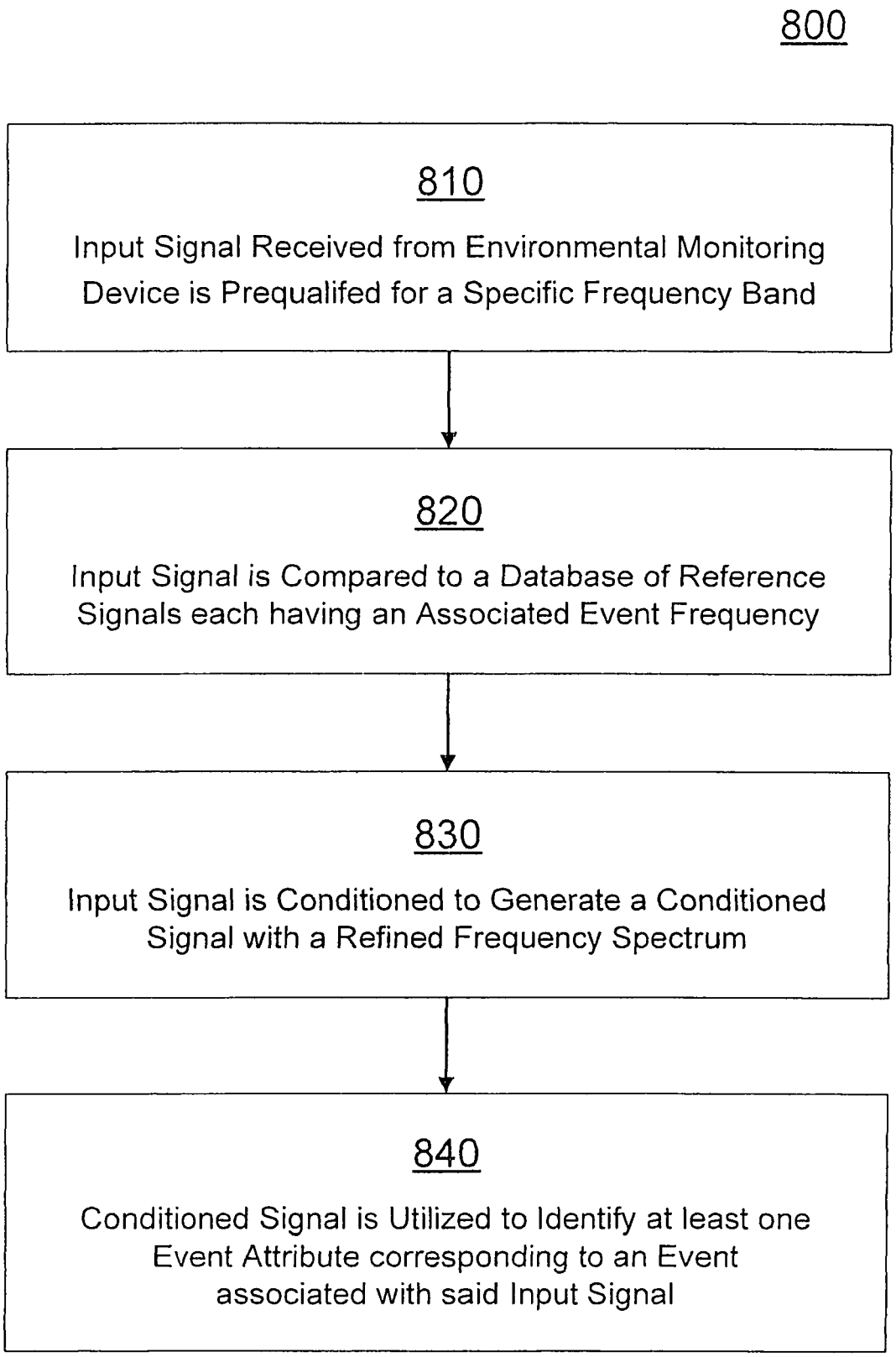
FIG. 8 is a flowchart of an exemplary method of event detection in accordance with an embodiment of the present technology.

With reference now to FIG. 8, an exemplary method 800 of event detection according to an embodiment of the present invention is shown. The method 800 comprises prequalifying an input signal received from an environmental monitoring device for a specific frequency band 810. The input signal is also compared to a database of reference signals each having an associated event frequency 820. The method 800 further comprises conditioning the input signal to generate a conditioned signal with a refined frequency spectrum 830. For instance, in one embodiment, when comparing the input signal to a database of reference signals 820 results in a match between the input signal and a reference signal from the database, a conditioned signal with a refined frequency spectrum is generated in response to the match.

With reference still to FIG. 8, the method 800 comprises utilizing the conditioned signal to identify at least one event attribute corresponding to an event associated with the input signal 840. In one embodiment, a corresponding event attribute is selected from a group of event types consisting of a specific calibers of gunshots, types of firecrackers, cars backfiring, aerosol spray can discharges, pipeline leaks, spoken words, faces associated with specific people, images of guns, images of knives, unique vehicle license plates, or toxic chemicals. Thus, the method 800 is configured to identify highly specific event information with respect to past event detection processes.

In another embodiment of the present technology, the method 800 further comprises outputting an identified event attribute. For instance, an output signal could be generated that identifies at least one event attribute corresponding to an event associated with an input signal, and this output signal could be transmitted to a receiver. The output signal could then be obtained from the receiver and analyzed in order to obtain information about an event associated with the input signal.

It should be understood by those skilled in the art that the method 800 may be expanded such that one or more specific types of input signals may be processed. For example, the method could include processing an input signal that is associated with an input selected from a group of possible input signal receivers consisting of electronic, magnetic, electromagnetic audio, visual, olfactory, taste-sensory, temperature, pressure, and radioactive data receivers. For instance, in one embodiment, the environmental monitoring device is utilized to detect a pungent odor in a monitored environment, and the input signal that is received from the environmental monitoring device comprises information corresponding to the detected olfactory data.

The method 800 of FIG. 8 can be further expanded so as to include other data acquisition and processing operations, depending on the needs and objectives of a user. For instance, in one embodiment, the method 800 comprises initiating a second environmental monitoring device when the input signal is prequalified, and receiving a second input signal from the second environmental monitoring device. The use of two or more environmental monitoring devices would increase the physical range within an environment in which data may be captured. Indeed, a first input signal and a second input signal may be associated with different environmental data types in order to further increase the scope of data capture and analysis so as to include a range of processed data types corresponding to a detected event.

In another embodiment, prequalifying 810 the input signal comprises the implementation of a frequency check to determine whether the input signal oscillates within a specific frequency spectrum. In an alternative embodiment, the method 800 comprises prequalifying one or more other inputs along with the input signal. Indeed, the prequalification of an input signal could be dependent on the successful prequalification of one or more other inputs in order to implement a multi-input prequalification analysis. Thus, it is understood that the prequalification stage 810 of the method 800 of event detection may be implemented in different ways to achieve different goals.

With reference still to FIG. 8, the method 800 may be further expanded such that acquired visual data is processed. In one embodiment, the method 800 comprises implementing a machine vision algorithm when the input signal is associated with visual data. For instance, the machine vision algorithm could be configured to analyze an image feature associated with the visual data. In one example, the method 800 comprises identifying an image feature based on visual traits exhibited by the feature.

In another embodiment, a still image triggered event is implemented that processes data associated with acquired still images. For example, the still image triggered event could be utilized to analyze physical attributes associated with a foreground image located in a captured still image, or could even be used to enhance an attribute associated with an object in an image (e.g., sharpness, brightness, color contrast, size) such that the object in the image can be more easily analyzed.

In an alternative embodiment, the method comprises utilizing a video triggered event to process data associated with detected motion. For instance, the video triggered event could be utilized to analyze movement of a foreground object present in a captured video clip relative to other foreground objects or a stationary background. In another example, the video triggered event is used to identify characteristics of an object in a captured video clip so that the object can be identified.

With reference still to FIG. 8, the method 800 of event detection may be further expanded to include automatically executing a predefined action in response to an identified event. For instance, in one embodiment, if either the still image triggered or video triggered events succeed in identifying an object of interest in an acquired still image or captured video footage, the method 800 could comprise automatically notifying a predefined person of such identification. Implementation of this embodiment would be valuable for a variety of applications, such as homeland security. For example, the method 800 could be instituted at an airport wherein still image triggered and video triggered events are used to analyze facial features of persons present in a particular airport terminal. Upon identifying a person of interest, the method 800 would further comprise automatically notifying airport security, local police, and federal authorities of the presence of such an individual.

The method 800 of FIG. 8 may also be expanded to include storing data for various purposes. For instance, in an embodiment of the present technology, processed data is stored in a storage unit such that the processed data may be subsequently retrieved and further processed. For example, a hard disk drive (HDD) may be implemented in which a magnetic read/write head in a head gimbal assembly (HGA) that is coupled to a moveable actuator arm is used to magnetically write data to a magnetic storage medium in the drive. The read/write head may then magnetically read the data from the magnetic storage medium such that the data may be later accessed and further processed at a subsequent point in time.

In another example, random access memory (RAM) is used to electronically store the data by means of arrays of electronic capacitors that are configured to acquire an electronic charge, wherein the charging of the capacitor arrays corresponds to a digital representation of the acquired data. However, it is understood that the aforementioned examples are merely exemplary of different storage units that may be implemented pursuant to various embodiments of the present technology. Other suitable storage units may also be utilized to store data such that it may be later accessed and processed. For instance, a portable flash drive may be used to store data, and the flash drive could be physically transported from a first computing system to a second computing system, wherein both computing systems are capable of accessing data stored on the drive.

In another example, the method 800 could comprise automatically routing data to a specific storage unit having the capacity to store such data. For instance, in one embodiment, it is first decided that specific data should be stored in a storage unit. The method 800 of the present embodiment would further comprise analyzing the amount of data that needs to be stored, and checking the storage capacity of two or more storage units. Next, a specific storage unit having the requisite degree of storage capacity would be identified, and the data would be automatically routed to the unit, where it would be stored such that the data could be subsequently accessed and analyzed.

In another embodiment of the present invention, the method 800 comprises utilizing a set of trained data to confirm the occurrence of a specific event type. For instance, the trained data may include a set of identifying factors related to a plurality of possible event attributes. This trained data could then be accessed such that the set of identifying factors could be analyzed such that a specific event attribute associated with an event of interest may be identified and further analyzed. Thus, the utilization of a set of trained data could be used to obtain a greater amount of information regarding possible event attributes.

In one example implementing principles of the present technology, the method 800 further comprises implementation of an algorithm that arranges the trained data such that specific identifying factors and related information are arranged according to characteristic attributes associated with these factors. In another example, a filtering algorithm is used to identify a range of identifying factors among the set of trained data, wherein the factors within the targeted range all share one or more characteristic attributes. In this way, the trained data may be filtered according to an attribute associated with an identified event, and the trained data may be utilized to obtain more information regarding a specific event attribute of interest.

It should be appreciated by those skilled in the art that the method 800 may further include an accuracy assessment regarding an identified attribute. In one embodiment, the method comprises calculating a specific degree of accuracy associated with the identification of a particular event attribute with respect to an input signal received from an environmental monitoring device. For example, the method 800 could comprise analyzing a group of identifying factors among a set of trained data, wherein the group of identifying factors relates to a plurality of possible event attributes, and deciding that a single event attribute cannot be identified with absolute certainty. In this scenario, two or more event attributes that may possibly correspond to an event associated with a received input signal may be selected, and each of these selected attributes may be further analyzed and assigned a specific degree of accuracy regarding their possible associations with the input signal. Those skilled in the art should appreciate that such a characterization may be carried out by comparing and contrasting characteristic attributes associated with each possible event attribute and the received input signal, and utilizing the results of this analysis to generate and assign a statistical probability tag to each possible event attribute with respect to the input signal.

Figure 9:
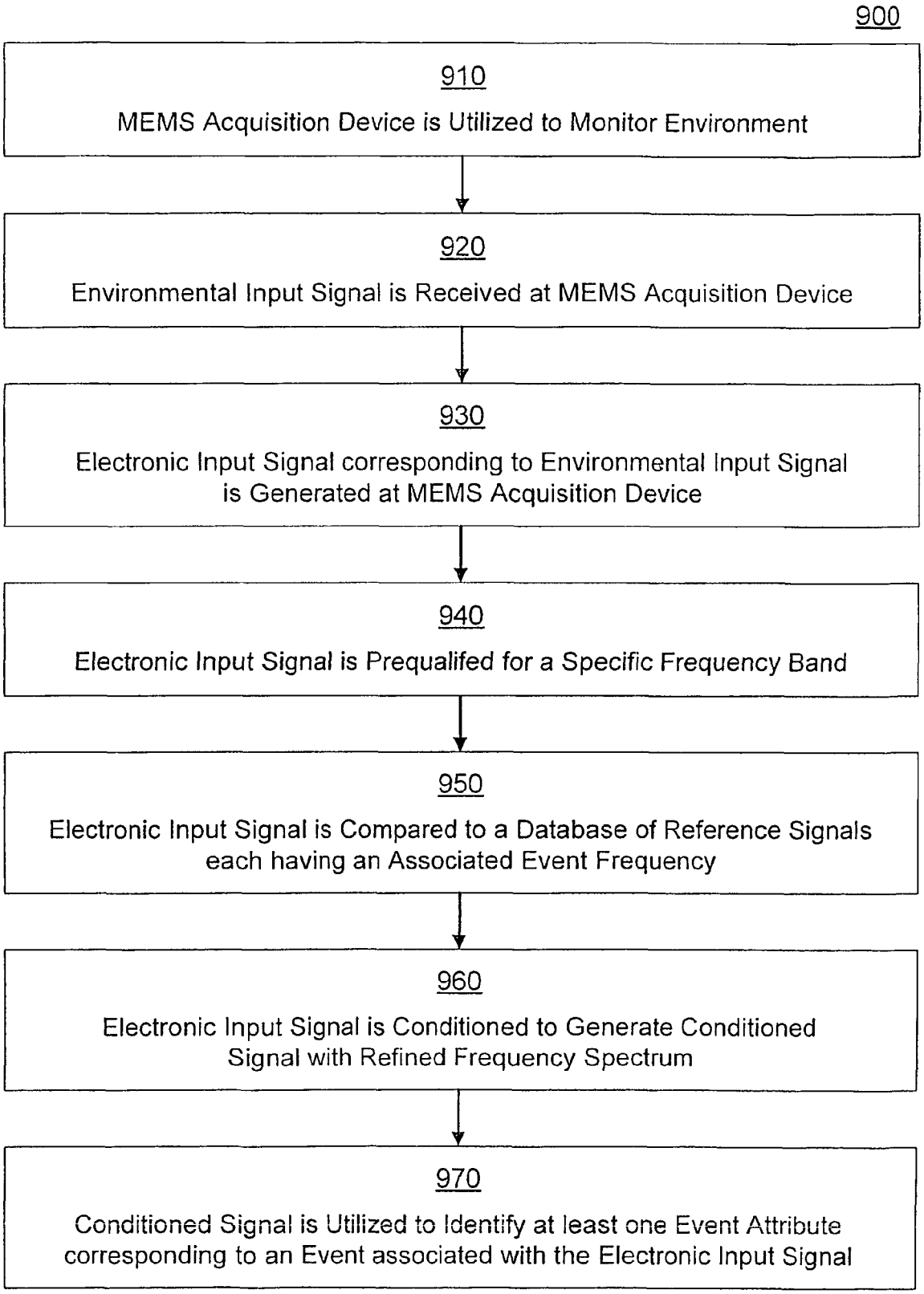
FIG. 9 is a flowchart of an exemplary method of environmental monitoring and event detection in accordance with an embodiment of the present technology.

With reference now to FIG. 9, an exemplary method 900 of environmental monitoring and event detection according to an embodiment of the present invention is shown. The method 900 comprises utilizing a micro-electromechanical (MEMS) based acquisition device to monitor an environment 910, receiving an environmental input signal at the MEMS based acquisition device 920, and generating an electronic input signal at the MEMS based acquisition device, wherein the electronic input signal corresponds to the environmental input signal 930. For instance, in one embodiment, the method 900 includes sensing mechanical vibrations in an ambient environment and creates an electrical signal having characteristic electronic amplitudes and frequencies that mirror the mechanical amplitudes and frequencies of the sensed vibrations.

The method 900 of FIG. 9 further comprises prequalifying the electronic input signal for a specific frequency band 940 and comparing the electronic input signal to a database of reference signals 950. For instance, each reference signal in the database could have an associated event frequency range, and these event frequency ranges could be compared with an electronic frequency range of the prequalified electronic input signal in order to identify an event associated with the environmental input signal. Indeed, the reference signals in the database could even be filtered prior to being compared with the prequalified input signal in order to shorten the requisite duration of time required to adequately compare the electronic input signal to the database of reference signals 950. In this way, only a select group reference signals from the database would need to be individually compared to the electronic input signal, which would serve to increase the efficiency of the method 900.

With reference still to FIG. 9, the method 900 further comprises conditioning the electronic input signal to generate a conditioned signal with a refined frequency spectrum 960, and utilizing the conditioned signal to identify at least one event attribute corresponding to an event associated with the electronic input signal 970. For instance, when the comparison between the electronic input signal and the database of reference signals results in a match, a conditioned signal with an associated refined frequency spectrum could be generated, and this conditioned signal could be compared to a specific group of possible event attributes having characteristic frequencies within the refined frequency spectrum of the conditioned signal. Then, one or more event attributes are identified as being associated to the electronic input signal based on a correlation between their respective characteristic frequencies and a characteristic frequency of the input signal.

It should be appreciated by those skilled in the art that there may be instances when further information pertaining to possible event attributes needs to be obtained in order to adequately identify the event attributes corresponding to an event associated with an electronic input signal. For instance, the amount of relevant information that is locally available may be limited to a relatively small number of possible event attributes. In addition, the available information may not be up to date. For example, new data relating to a more accurate assessment of a characteristic frequency associated with a possible event attribute may exist in a remote database, and this new data might be valuable to a present analysis of such event attribute. Thus, another embodiment of the present invention includes communicating with a remote database comprising information associated with a plurality of event attributes, and obtaining new information associated with a specific event attribute. In this manner, locally accessible data may be periodically updated such that a more thorough analysis may be performed.

In another embodiment, the method 900 also includes outputting one or more identified event attributes so that another entity may be informed of the specific event attributes that were identified during execution of the method 900. For example, an output signal could be generated, wherein the output signal identifies at least one event attribute that has been identified. This output signal could then be transmitted to a remote receiver coupled to a remotely located communication system. The communication system could then be utilized to communicate the contents of the output signal to one or more interested parties.

In one embodiment of the present technology, the method 900 comprises wirelessly transmitting the generated output signal to a remote receiver. For instance, if an analog output signal is generated, the signal could be transmitted using AM or FM communication technologies in which the output signal is modulated with a carrier signal, and then electromagnetically communicated from a transmitter to a remote receiver. Once the modulated signal has been received, a predefined demodulation algorithm would be used to reconstruct the original output signal, and the contents of the output signal could then be remotely analyzed. In one embodiment, a remote transceiver is utilized to receive the modulated output signal from the transmitter, and the signal is then remotely routed to another receiver. This implementation allows for long range communication of the output signal over a relatively larger area.

In another embodiment, the method 900 comprises implementing a pulse-code modulation (PCM) algorithm to create a digital representation of an analog output signal that identifies one or more event attributes associated with an electronic input signal. The analog output signal is sampled at uniform intervals, and theses samples are then quantized according to a discrete set of integer values. The quantized samples of the output signal are translated into a digital format that is communicated to a remote receiver, at which point a remotely located communication system coupled to the remote receiver can reconstruct the analog output signal and analyze its contents.

It is understood, however, that the aforementioned modulation algorithms are only examples of how to implement principles of the present technology pursuant to various specific embodiments. Indeed, a wide range of communication technologies may be utilized to transmit information pertaining to an identified event attribute. For instance, the method 900 could further comprise wirelessly transmitting an output signal to a remote receiver by implementing a communication technology selected from a group of communication technologies consisting of AM, FM, PCM, GPS, RS232, RS485, USB, firewire, infrared and fiber optic communication technologies.

It should be further understood that the examples and embodiments pertaining to the systems and methods disclosed herein are not meant to limit the possible implementations of the present technology. Indeed, one of the disclosed systems or methods may be expanded so as to implement an example or embodiment pertaining to another disclosed system or method depending on the needs of one practicing principles of the present technology. In addition, various embodiments of the disclosed systems and methods may also be combined, for instance, to create a more comprehensive and thorough process for monitoring an environment and identifying an event attribute associated with an event transpiring in the monitored environment.

For example, as described herein, the present technology provides a system and method of advanced event detection that may be used to specifically identify a range of events occurring in a within a monitored environment. In addition, the present technology provides a system and method for conditioning a signal received at a MEMS based acquisition device. Those skilled in the art will appreciate that advances in modern MEMS technology would allow the MEMS based acquisition device implemented in various embodiments of the present invention to be configured to scan for a specific type of event selected from a wide range of events that are capable of being detected, and a disclosed event detection process could then be implemented to identify the detected event.

The foregoing notwithstanding, the present technology also provides a system and method for prequalifying a signal for a specific frequency range, as well as an advanced system and method of refined conditioning. Therefore, a person skilled in the art could implement a combination of embodiments in which a specific type of input is succinctly processed and analyzed in order to yield a more refined analysis with respect to past technologies. For example, the extensibility of modern day MEMS technology could be combined with the disclosed prequalification and refined conditioning technologies in order to monitor an environment for the presence of a specific toxic chemical. A MEMS based acquisition device could be configured to monitor for a range of chemicals, and then generate an input signal that communicates specific attributes associated with a detected chemical. The prequalification and refined conditioning processes could then be utilized to implement a refined analysis of these specific attributes in order to determine whether the detected chemical is toxic to humans.

Thus, the environmental monitoring and event determination technology disclosed herein has a myriad of practical uses. In particular, due to the ability of the technology to pinpoint the precise caliber of a discharged weapon, embodiments of the present invention would be very useful for military and law enforcement applications. For example, one embodiment of the present technology could comprise a mobile gunshot detection unit that may be mounted in a police cruiser. Upon hearing what sounds like a gunshot, the law enforcement officer can check the mobile gunshot detection unit in order to make sure that the sound was in fact a gunshot, rather than a confusingly similar sound (e.g., a car backfiring) . Once the law enforcement officer is confident that the sound was the result of a discharged firearm, the officer can contact the police dispatch unit and report the event. Thus, in this example, application of the embodiment would translate into fewer false alarms, which has the practical application of preserving precious police department resources for genuine emergencies.

As a second example, an embodiment of the present technology could be implemented so as to allow a soldier in a theater of war to not only be sure that a gunshot was fired, but to also pinpoint the precise caliber of the weapon that fired the round. This will enable the soldier to make a more informed decision regarding how to react to the gunshot (e.g., should he simply alert his squad, or should he radio in for an even greater degree of reinforcement).

In another embodiment of the present technology, an array of MEMS based acquisition devices are utilized in a pipeline leak detection system. For instance, a MEMS device could be installed at various points along an intricate network of pipeline. The MEMS devices could each be configured to monitor for a specific frequency spectrum, such as a frequency range associated with sounds resulting from pipeline leaks. Upon detecting the sound of a leak in a pipeline, the pipeline leak detection system would communicate to a system user, such as by sending a wireless or hard line transmission, the location of the leak. In this way, engineers and technicians having the arduous task of finding leaks in a large pipeline network would be able to more quickly recognize a leak, pinpoint its location and remedy the problem.

The electronic systems discussed herein are merely examples of how suitable computing environments for the present technology might be implemented, and are not intended to suggest any limitation as to the scope of use or functionality of the present technology. Neither should such electronic systems be interpreted as having any dependency or requirement relating to any one or combination of components illustrated in the disclosed examples.

The present technology is operational with numerous other general-purpose or special-purpose computing system environments or configurations. Examples of well known computing systems, environments, and configurations that may be suitable for use with the present technology include, but are not limited to, personal computers, server computers, hand-held or laptop devices, multiprocessor systems, microprocessor-based systems, set-top boxes, programmable consumer electronics, network PCs, minicomputers, mainframe computers, distributed computing environments that include any of the above systems or devices, and the like.

The present technology may be described in the general context of computer-executable instructions, such as program modules, being executed by a computer. Generally, program modules include routines, programs, objects, components, data structures, etc., that perform particular tasks or implement particular abstract data types. The present technology may also be practiced in distributed computing environments where tasks are performed by remote processing devices that are linked through a communications network. In a distributed computing environment, program modules may be located in both local and remote computer-storage media including memory-storage devices.

Although the subject matter has been described in a language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An environmental monitor comprising:

a micro-electromechanical (MEMS) based acquisition device that monitors an environment, receives at least one sound signal from within said environment, and generates an input signal comprising an electronic representation of said sound signal; and a signal conditioner coupled with said MEMS based acquisition device, said signal conditioner receiving said input signal from said MEMS based acquisition device and comparing said input signal against at least one specific frequency band.

2. The environmental monitor of claim 1 wherein the MEMS based acquisition device is selectively powered on and off to facilitate selective monitoring of said environment.

3. The environmental monitor of claim 1 wherein the MEMS based acquisition device is selectively powered up and selectively powered-down to extend a battery life of said MEMS based acquisition device.

4. The environmental monitor of claim 1 wherein said MEMS based acquisition device monitors an environment for input signal frequencies ranging from 0 kHz-100 kHz.

5. The environmental monitor of claim 1 wherein said at least one frequency band monitored by said MEMS based acquisition device includes a range of frequencies within which gunshot sounds resonate.

6. The environmental monitor of claim 1 wherein said at least one frequency band monitored by said MEMS based acquisition device includes a range of frequencies within which spray can discharge sounds resonate.

7. The environmental monitor of claim 1 wherein said input signal is conditioned within at least one specific frequency band to provide a refined version of said input signal for future analysis.

* * * * *